US011380983B2

(12) United States Patent
Chen

(10) Patent No.: US 11,380,983 B2
(45) Date of Patent: Jul. 5, 2022

(54) RADOME FOR BASE STATION ANTENNA AND BASE STATION ANTENNA

(71) Applicant: CommScope Technologies LLC, Hickory, NC (US)

(72) Inventor: Changfu Chen, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 95 days.

(21) Appl. No.: 17/102,702

(22) Filed: Nov. 24, 2020

(65) Prior Publication Data

US 2021/0175617 A1 Jun. 10, 2021

(30) Foreign Application Priority Data

Dec. 9, 2019 (CN) ..... 201911246929.1

(51) Int. Cl.
*H01Q 1/42* (2006.01)
*H01Q 1/24* (2006.01)

(52) U.S. Cl.
CPC ..... *H01Q 1/422* (2013.01); *H01Q 1/246* (2013.01)

(58) Field of Classification Search
CPC ..... H01Q 1/42; H01Q 1/24
USPC ..... 343/700 R
See application file for complete search history.

(56) References Cited

U.S. PATENT DOCUMENTS

2012/0194399 A1* 8/2012 Bily ..... H01Q 15/02 343/700 R
2019/0148827 A1* 5/2019 Lenive ..... H01P 1/2039 343/700 R

* cited by examiner

*Primary Examiner* — Andrea Lindgren Baltzell
(74) *Attorney, Agent, or Firm* — Myers Bigel, P.A.

(57) ABSTRACT

Radomes for a base station antenna include a first dielectric layer having a first dielectric constant and a first thickness, a second dielectric layer having a second dielectric constant and a second thickness, the second dielectric layer being positioned on an outer side of the first dielectric layer; and a third dielectric layer having a third dielectric constant and a third thickness, the third dielectric layer being positioned on an outer side of the second dielectric layer. Each of the first and third dielectric constants is greater than the second dielectric constant.

21 Claims, 8 Drawing Sheets

RADOME FOR BASE STATION ANTENNA AND BASE STATION ANTENNA

RELATED APPLICATION

The present application claims priority to and the benefit of Chinese Patent Application No. 201911246929.1, filed Dec. 9, 2019, the content of which is hereby incorporated herein in its entirety.

FIELD OF THE INVENTION

The present invention relates to communication systems and, more particularly, to radomes for base station antennas and base station antennas.

DESCRIPTION OF RELATED ART

Most base station antennas include a radome, which is used to protect internal electronic components of the antenna from the external environment and to reduce wind loads on the antenna. FIG. 1 is a schematic horizontal cross-sectional view of a conventional base station antenna. The conventional base station antenna includes a dielectric radome 1 mounted on a mounting plate 20 and an array 30 of radiating elements 31 that are mounted on the mounting plate 20 adjacent the inner side of the radome 1. In the example shown in FIG. 1, each row of the array 30 of radiating elements (the rows extend along a width direction of the base station antenna, which is also referred to as a horizontal direction) includes four radiating elements 31. Each T-shaped portion in the figure represents a column (along a length direction, which is also referred to as a vertical direction, of the base station antenna) of radiating elements 31, where each column may include one or more radiating elements 31. The mounting plate 20 may function as a reflector and a ground plane for the radiating elements 31.

SUMMARY

Embodiments the present invention are directed to a radome for a base station antenna and the base station antenna suitable for use in a communication system.

A first aspect of the present invention is a radome for a base station antenna. The radome for a base station antenna includes: a first dielectric layer having a first dielectric constant and a first thickness; a second dielectric layer having a second dielectric constant and a second thickness, the second dielectric layer being positioned on an outer side of the first dielectric layer; and a third dielectric layer having a third dielectric constant and a third thickness, the third dielectric layer being positioned on an outer side of the second dielectric layer. Each of the first and third dielectric constants is greater than the second dielectric constant.

Another aspect of the present invention is a base station antenna. The base station antenna can include: an array of radiating elements; and a radome described above. The first dielectric layer can be closer to the array of radiating elements than the third dielectric layer.

A third aspect of this disclosure is to a base station antenna that includes: an array of radiating elements configured to emit an electromagnetic wave; a radome including a first dielectric layer, the first dielectric layer having a first dielectric constant and a first thickness; and a dielectric plate that is extending between the array of radiating elements and the radome, the dielectric plate having a second dielectric constant and a second thickness. There is a first gas between the dielectric plate and the radome, and each of the first and second dielectric constants is greater than a dielectric constant of the first gas, and a shape of the dielectric plate matches a shape of a corresponding portion of the radome.

Other features of the present invention and advantages thereof will become explicit by means of the following detailed descriptions of exemplary embodiments of the present invention with reference to the drawings.

BRIEF DESCRIPTION OF THE DRAWINGS

The accompanying drawings, which constitute a part of the specification, illustrate embodiments of the present invention and, together with the description, serve to explain the principles of the present invention.

Figure 1:
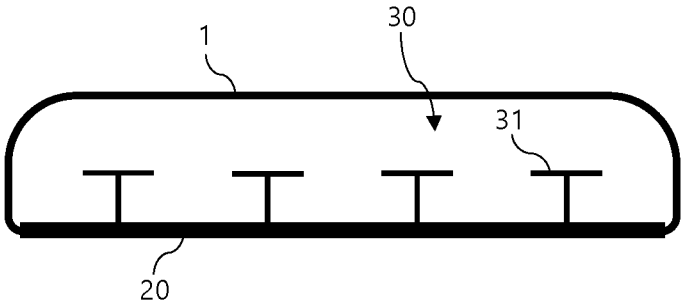
FIG. 1 is a schematic horizontal cross-sectional view of a conventional base station antenna.

Note that, in some cases the same elements or elements having similar functions are denoted by the same reference numerals in different drawings, and description of such elements is not repeated. In some cases, similar reference numerals and letters are used to refer to similar elements, and thus once an element is defined in one figure, it need not be further discussed for following figures.

In order to facilitate understanding, the position, size, range, or the like of each structure illustrated in the drawings may not be drawn to scale. Thus, the disclosure is not necessarily limited to the position, size, range, or the like as disclosed in the drawings.

DETAILED DESCRIPTION

The present invention will be described with reference to the accompanying drawings, which show a number of example embodiments thereof. It should be understood, however, that the present invention can be embodied in many different ways, and is not limited to the embodiments described below. Rather, the embodiments described below are intended to make the disclosure of the present invention more complete and fully convey the scope of the present invention to those skilled in the art. It should also be understood that the embodiments disclosed herein can be combined in any way to provide many additional embodiments.

The terminology used herein is for the purpose of describing particular embodiments, but is not intended to limit the scope of the present invention. All terms (including technical terms and scientific terms) used herein have meanings commonly understood by those skilled in the art unless otherwise defined. For the sake of brevity and/or clarity, well-known functions or structures may be not described in detail.

Herein, when an element is described as located "on" "attached" to, "connected" to, "coupled" to or "in contact with" another element, etc., the element can be directly located on, attached to, connected to, coupled to or in contact with the other element, or there may be one or more intervening elements present. In contrast, when an element is described as "directly" located "on", "directly attached" to, "directly connected" to, "directly coupled" to or "in direct contact with" another element, there are no intervening elements present. In the description, references that a first element is arranged "adjacent" a second element can mean that the first element has a part that overlaps the second element or a part that is located above or below the second element.

Herein, the foregoing description may refer to elements or nodes or features being "connected" or "coupled" together. As used herein, unless expressly stated otherwise, "connected" means that one element/node/feature is electrically, mechanically, logically or otherwise directly joined to (or directly communicates with) another element/node/feature. Likewise, unless expressly stated otherwise, "coupled" means that one element/node/feature may be mechanically, electrically, logically or otherwise joined to another element/node/feature in either a direct or indirect manner to permit interaction even though the two features may not be directly connected. That is, "coupled" is intended to encompass both direct and indirect joining of elements or other features, including connection with one or more intervening elements.

Herein, terms such as "upper", "lower", "left", "right", "front", "rear", "high", "low" may be used to describe the spatial relationship between different elements as they are shown in the drawings. It should be understood that in addition to orientations shown in the drawings, the above terms may also encompass different orientations of the device during use or operation. For example, when the device in the drawings is inverted, a first feature that was described as being "below" a second feature can be then described as being "above" the second feature. The device may be oriented otherwise (rotated 90 degrees or at other orientation), and the relative spatial relationship between the features will be correspondingly interpreted.

Herein, the term "A or B" used through the specification refers to "A and B" and "A or B" rather than meaning that A and B are exclusive, unless otherwise specified.

The term "exemplary", as used herein, means "serving as an example, instance, or illustration", rather than as a "model" that would be exactly duplicated. Any implementation described herein as exemplary is not necessarily to be construed as preferred or advantageous over other implementations. Furthermore, there is no intention to be bound by any expressed or implied theory presented in the detailed description.

Herein, the term "substantially", is intended to encompass any slight variations due to design or manufacturing imperfections, device or component tolerances, environmental effects and/or other factors. The term "substantially" also allows for variation from a perfect or ideal case due to parasitic effects, noise, and other practical considerations that may be present in an actual implementation.

Herein, certain terminology, such as the terms "first", "second" and the like, may also be used in the following description for the purpose of reference only, and thus are not intended to be limiting. For example, the terms "first", "second" and other such numerical terms referring to structures or elements do not imply a sequence or order unless clearly indicated by the context.

Further, it should be noted that, the terms "comprise", "include", "have" and any other variants, as used herein, specify the presence of stated features, steps, operations, elements, and/or components, but do not preclude the presence or addition of one or more other features, steps, operations, elements, components, and/or groups thereof.

A radome for a base station antenna should have sufficient mechanical strength and good electrical performance such as high transmissivity (which means low reflectivity) over the entire operating frequency band of the base station antenna with respect to all scanning angles of the array of radiating elements. In the fifth generation of mobile communications, the frequency range of communications includes a dominant frequency band (which is in specified portions of the 450 MHz~6 GHz range) and an extended frequency band (24 GHz~52 GHz, namely a millimeter wave frequency band, primarily 28 GHz, 39 GHz, 60 GHz and 73 GHz). The frequency ranges that will be used in fifth generation mobile communications include frequency bands that are higher than those used in previous generations of mobile communications. Therefore, it is desirable that radomes for fifth generation base station antennas have high electrical performance in these higher frequency ranges. The dielectric material of the radome for the base station antenna is typically frequency-selective to electromagnetic waves. The higher the frequency of the electromagnetic wave is, the greater effect the dielectric material may have on the electromagnetic wave, for example, the worse transmissivity and the higher reflectivity. The deterioration of the transmissivity may decrease the intensity of electromagnetic wave signals, and hence the gain of the base station antenna. The higher the reflectivity is, the more electromagnetic waves will be reflected back from the radome. These reflected waves may be superimposed with the electromagnetic waves emitted from the radiating elements to cause jitter and ripple in the pattern. These are all undesirable effects.

The incident angles at which electromagnetic waves impinge upon a radome also may impact the performance of a base station antenna. In particular, when an electromagnetic wave has a large incident angle, the electrical performance of the radome may decline significantly. In a communication system, the free space or "path" loss increases with increasing frequency. Thus, for high frequency communications, multiple input multiple output (MIMO) technology is typically employed to compensate for the path loss. In the fifth generation of mobile communications, especially within the millimeter wave frequency band, the base station antenna may generate radiation patterns or "antenna beams" that have high gain and small beamwidth by using massive MIMO technology, and may perform electronic beam scanning by changing the pointing directions of the antenna beams in the azimuth and/or elevation planes (where the pointing direction of an antenna beam may refer to the direction where the antenna beam exhibits peak gain) so as to cover a predetermined spatial range within a predetermined time of period to improve signal coverage and reduce interference. FIG. 2 illustrates several antenna beams that are electronically scanned to point in a variety of different horizontal directions. Each antenna beam shown in FIG. 2 has a different incident angle with respect to the radome, where the straight line P1 schematically represents the projection of a plane of the radome for receiving electromagnetic waves in the cross-sectional view, the antenna beam B1 points in a direction D1 in which the scanning angle is 0 degree, the antenna beam B2 points in a direction D2 in which the scanning angle is 30 degrees, and the antenna beam B3 points in a direction D3 in which the scanning angle is 60 degrees. Directions D4 and D5 are directions that are symmetric with directions D2 and D3, respectively, although the corresponding antenna beams are not shown. Incident angles of the antenna beams corresponding to the directions D2 to D5, with respect to the radome, are shown as θ2 to θ5 respectively. The antenna beam B1 corresponding to the direction D1 in the figure has an incident angle of 0 degrees with respect to the radome (not shown). When the antenna beam points in a direction in which the scanning angle is larger, the incident angle of the antenna beam with respect to the radome is larger as well. When the incident angle is large, the electrical performance of the radome will be degraded, for example, the transmissivity may be degraded and the reflectivity may be increased. The massive MIMO technology may execute beam scanning in three-dimensional space within a sweeping angle range of ±60 degrees, that is, a range of sweeping angles of −60 degrees to +60 degrees may be used in both horizontal and vertical directions. For example, FIG. 2 may be used to show some scanning an antenna beam of the base station antenna of FIG. 1 in the vertical direction as well as the incident angles of these beams with respect to the radome. Therefore, there is a need for the radome to have a desirable transmissivity and reflectivity for electromagnetic waves having a large incident angle (for example, an incident angle of ±60 degrees).

Conventional radomes (for example, the radome 1 shown in FIG. 1) are divided into two types, radomes with thin-walled structures and radomes with thick-walled structures, both of which have low reflectivity. Radomes having a thin-walled structure may be less than λ/20 thick, where λ, is the wavelength of the electromagnetic wave in the dielectric of the radome. Such a thin-walled structure may allow for good transmissivity and reflectivity even when the electromagnetic wave has a large incident angle (for example, an incident angle of 70 degrees). However, for high frequencies such as 3.5 GHz, a thin-walled radome is less than 2 mm thick (calculated in terms of the dielectric constant of the radome being 4), which may be insufficient to meet the mechanical strength requirements for the radome. With respect to higher frequencies, the thickness of the radome will be reduced even further and such a radome will not be usable in a base station antenna. The radome with a thick-walled structure has a thickness of about λ/2 which, for high frequency electromagnetic waves, may meet the mechanical strength requirements for the radome. However, thick-walled radomes may have a small bandwidth, such as a bandwidth that is 5% of the center frequency of the operating frequency band. For example, for electromagnetic waves with a center frequency of 3.5 GHz, the radome with a thick-walled structure may only support a bandwidth of 175 MHz. This makes the radome obviously not suitable for using in the fifth generation of mobile communication system, where the operating frequency bands tend to exceed 5% (e.g., the operating frequency band for the 3.5 GHz frequency band is about 400 MHz).

Figure 3:
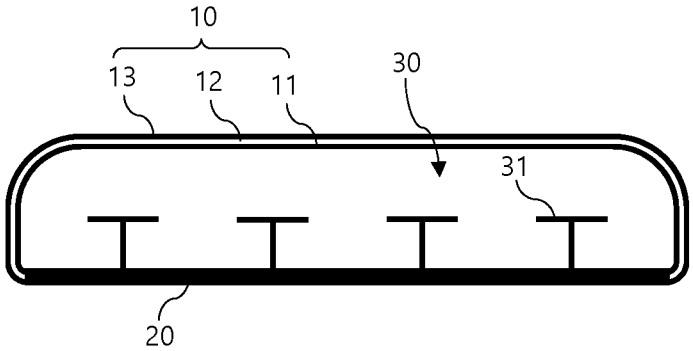
FIG. 3 is a schematic horizontal cross-sectional view of a base station antenna according to an embodiment of the present invention.
Figure 4:
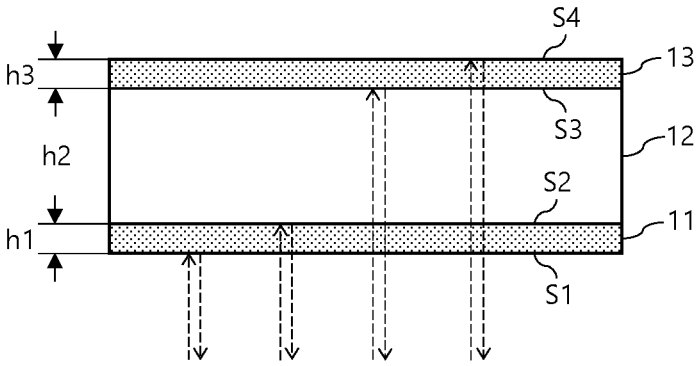
FIG. 4 is a partially enlarged schematic horizontal cross-sectional view of a small portion of the radome in FIG. 3.

FIGS. 3 and 4 schematically illustrate a base station antenna in accordance with an embodiment of the present invention. The depicted base station antenna includes a radome 10 in accordance with an embodiment of the present invention. The base station antenna further includes a mounting plate 20 and an array 30 of radiating elements 31 mounted on the outer side of the mounting plate 20. The radome 10 includes, from its inner side to outer side, dielectric layers 11 to 13. The inner side of the radome 10 refers to the side that is closest to the array 30 and the outer side refers to the side that is farther away from the array 30. The dielectric layer 11 forming the inner side of the radome 10 has a dielectric constant ε1 and a thickness h1, the dielectric layer 12 on the outer side of the dielectric layer 11 has a dielectric constant ε2 and a thickness h2, and the dielectric layer 13 on the outer side of the dielectric layer 12 that forms the outer side of the radome 10 has a dielectric constant ε3 and a thickness h3. The dielectric constants of the dielectric layers 11 to 13 meet the following relationship: dielectric constant is greater than dielectric constant ε2, and dielectric constant ε3 is greater than dielectric constant ε2. Dielectric materials that have high density and strength, such as reinforced glass fiber materials, may be selected to form the dielectric layers 11 and 13 having higher dielectric constants, in order to ensure the mechanical strength of the radome 10. Dielectric materials having low loss tangent and low density, for example, gaseous materials such as vacuum or gases, solid materials that are for example solid, honeycombed, foamed, porous and/or meshed, and even a suitable liquid material, may be selected to form the dielectric layer 12 having a lower dielectric constant, so as to allow the radome 10 to be less heavy. In addition, the solid materials that are for example honeycombed, foamed, porous and/or meshed may have a light weight even in case of being thick, and at the same time may have a high mechanical strength. Therefore, the radome 10 with such a structure may reach a high mechanical strength with a light weight, i.e., achieving a great strength-to-weight ratio.

Further, the radome 10 may exhibit good electrical performance as well. As shown in FIG. 4, electromagnetic waves that are transmitted through the radome 10 may pass through four interfaces S1 to S4. Transmission and/or reflection may occur at each of these interfaces. The dotted lines in the figure schematically illustrate incident waves having an incident angle of 0 degree and reflected waves having a reflection angle of 0 degree potentially occurring at each of the four interfaces S1 to S4. Designers of the radome 10 may adjust reflections of electromagnetic waves emitted by the array 30 on each of the four interfaces S1 to S4 by designing the thicknesses h1 to h3 and the dielectric constants ε1 to ε3 of each dielectric layers 11 to 13, such that these reflected waves are superimposed out of phase or even reverse phase so as to reduce the reflectivity of the entire radome 10, thereby enabling the entire radome 10 to meet transmissivity and reflectivity design goals.

A design process for the radome 10 may comprise designing a range of total thickness of the radome 10 according to the requirements for the mechanical strength and spatial size of the radome 10 of the base station antenna, and then designing the thicknesses and dielectric constants of the individual dielectric layers 11 to 13 within the range of total thickness so as to meet the requirements for electrical performance of the radome 10. Upon design of the dielectric constants of the individual dielectric layers 11 to 13, the materials of the dielectric layers 11 and 13, for example, a material commonly used for manufacturing the radome (such as ASA engineering plastics or the like) may be determined first, and then the dielectric constant of the dielectric layer 12 is adjusted and determined as required. In the event that the dielectric layer 12 is made of a solid material that is for example honeycombed, foamed, porous, and/or meshed, the dielectric constant of this material may be controlled precisely by controlling the density of voids in the material. Upon design of the thicknesses of the individual dielectric layers 11 to 13, the thicknesses of the dielectric layers 11 and 13 may be determined before the thickness of the dielectric layer 12 is adjusted and determined as required; alternatively, the thickness of the dielectric layer 12 may be determined before the thicknesses of the dielectric layers 11 and 13 are adjusted and determined as required.

In the embodiment shown in FIG. 4, the thickness h2 of the dielectric layer 12 is greater than both the thickness h1 of the dielectric layer 11 and the thickness h3 of the dielectric layer 13. With such a configuration, in the process of passing through the radome 10, the path over which the electromagnetic wave travels through the high-dielectric constant dielectric is shortened, thereby reducing the losses of the electromagnetic waves due to the radome 10. This may not only increase the transmittance of electromagnetic waves through the radome 10, but also increase the bandwidth of the radome 10. In some embodiments, the thickness h2 of the dielectric layer 12 is 2 to 15 times at least one of the thickness h1 of the dielectric layer 11 and the thickness h3 of the dielectric layer 13. For example, the thicknesses h1 and h3 of the dielectric layers 11 and 13 may both be 0.2 to 0.8 mm, the thickness h2 of the dielectric layer 12 may be 0.4 to 12 mm, and the total thickness of the radome 10 may be 0.8 to 13.6 mm. In some embodiments, the thickness h2 of the dielectric layer 12 is equal to or less than one quarter of the wavelength of the electromagnetic waves emitted by the array 30, in the dielectric layer 12. In the design flow of determining the thickness of the dielectric layer 12 before determining the thickness of the dielectric layers 11 and 13, the thickness of the dielectric layer 12 may be determined first according to the wavelength of the electromagnetic wave emitted by the array 30, in the dielectric layer 12, and then the thicknesses of the dielectric layers 11 and 13 are adjusted and determined based on the relationship between the thicknesses of the individual dielectric layers as described above.

In some embodiments, for ease of design, the dielectric layers 11 to 13 may be symmetrically configured, that is, the dielectric constants ε1 and ε3 of the dielectric layers 11 and 13 are equal, and/or the thicknesses h1 and h3 of the dielectric layers 11 and 13 are also equal. In some embodiments, the dielectric layer 13 on the outer side of the dielectric layer 12 may be a protective layer applied on the outer side of the dielectric layer 12. For example, a coating layer applied on the outer surface of the dielectric layer 12. When the conventional radome is formed of, for example, a woven fabric, a protective layer may be applied to the outer side thereof to resist water, dust or the like. In the radome according to embodiments of the present invention, the dielectric layer 13 of the radome 10 may be implemented as a protective layer. In some embodiments, the dielectric layers 11 and 13 may be made of glass fiber, and the dielectric layer 12 may be made of foam plastic, corrugated paper, or the like. In some embodiments, the dielectric layers 11 and 13 may be made of ASA engineering plastic, polyvinyl chloride (PVC), polycarbonate (PC), ABS plastic, or the like, and the dielectric layer 12 may be formed of air.

In some embodiments, the dielectric layers 11 through 13 are monolithic. The radome 10 may be integrally formed by an injection molding process. For example, after a molten plastic (may be any one or more of the plastic materials mentioned above) is injected into a mold, a gas is introduced into a portion corresponding to the dielectric layer 12 so that this portion includes air holes so as to form a foam plastic. In this example, the dielectric layers 11 and 13 are made of a higher density plastic, and the dielectric layer 12 is made of a lower density plastic, such that the dielectric constants of the dielectric layers 11 and 13 are larger than the dielectric constant of the dielectric layer 12. For another example, after the molten plastic is injected into the mold, impurities having a higher dielectric constant (such as ceramic particles) are doped into portions corresponding to the dielectric layers 11 and 13, so that the dielectric constants of the dielectric layers 11 and 13 are greater than the dielectric constant of the dielectric layer 12. For a further example, a mold whose intermediate layer is used for manufacturing a hollow layer may be used. The molten plastic is injected into this kind of mold and solidified, and then an integrally formed radome 10 in which the dielectric layers 11 and 13 are plastic and the dielectric layer 12 is air is obtained.

Figure 10A:
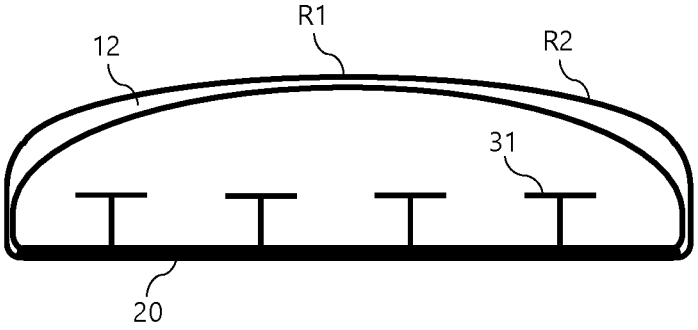
FIGS. 10A and 10B are schematic horizontal cross-sectional views of base station antennas according to further embodiments of the present invention.
Figure 10B:
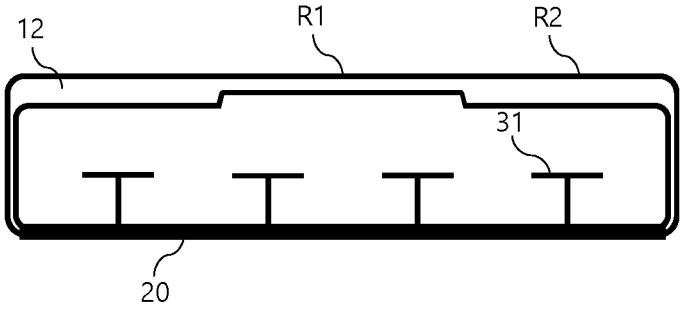

In the case where the dielectric constants of dielectric layers 11 to 13 and the thicknesses of the dielectric layers 11 and 13 are fixed, the larger the incident angle of the electromagnetic wave with respect to the radome 10, the greater the thickness that dielectric layer 12 will need to have in order to provide optimal transmittance through the radome 10. Thus, in some embodiments shown in FIGS. 10A and 10B, the radome 10 may be designed such that the dielectric layer 12 has a thickness that increases from a center portion R1 to an edge portion R2 (including one or more of left edge portion, right edge portion, upper edge portion, and lower edge portion) of the radome 10. The thickness h2 of the dielectric layer 12 may be increased smoothly (as shown in FIG. 10A) or may be increased stepwise. It is even possible to design the thickness h2 to include two thickness values, as shown in FIG. 10B, a smaller first thickness value in the center portion R1 of the radome 10, and a larger second thickness value in the edge portion R2 of the radome 10.

Figure 5:
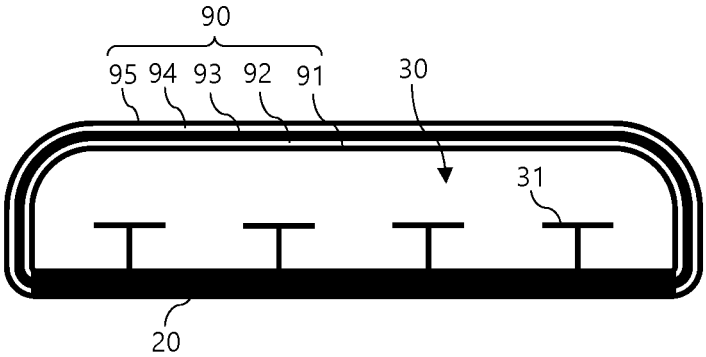
FIG. 5 is a schematic horizontal cross-sectional view of a base station antenna according to another embodiment of the present invention.
Figure 6:
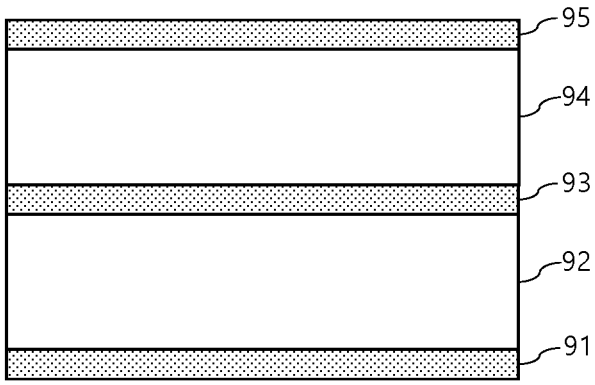
FIG. 6 is a partially enlarged schematic horizontal cross-sectional view of a small portion of the radome in FIG. 5.

FIGS. 5 and 6 schematically illustrate a base station antenna that includes a radome 90 in accordance with another embodiment of the present invention. The base station antenna also includes the mounting plate 20 and the array 30 of radiating elements 31 which are the same as or similar to those in the embodiment as described above. The radome 90 includes, from the inner side to the outer side, dielectric layers 91 to 95 having respective dielectric constants of ε1 to ε5 and respective thicknesses of h1 to h5. The dielectric constants meet the following relationship: ε1>ε2, ε3>ε2, ε3>ε4, and ε5>ε4, and the thicknesses meet the following relationship: h2>h1, h2>h3, h4>h3, and h4>h5. The dielectric layers 91 to 93 and the dielectric layers 93 to 95 may have configurations similar to those of the dielectric layers 11 to 13 as described in the above embodiment respectively, and thus will not be described herein again. Compared to the above embodiment, the radome 90 may be designed in more dimensions and thus is more likely to achieve better performance.

Figure 7A:
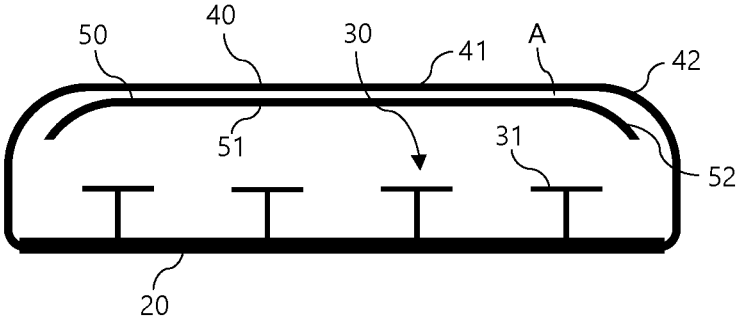
FIGS. 7A and 7B are schematic horizontal cross-sectional views of base station antennas according to further embodiments of the present invention.
Figure 7B:
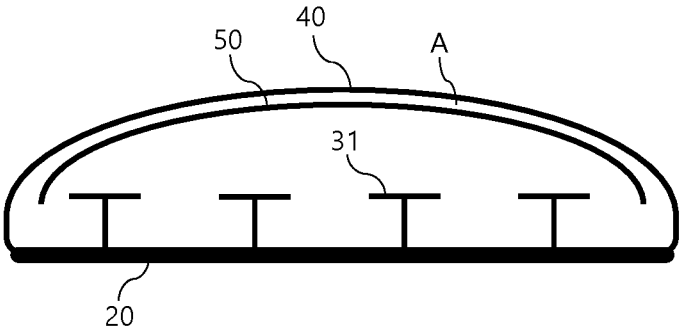

FIGS. 7A and 7B schematically show base station antennas according to further embodiments of the present invention. The base station antenna includes a radome 40 in addition to the mounting plate 20 and the array 30 of radiating elements 31 which are the same as or similar to those in the above described embodiments. The radome 40 may be any known radome including a dielectric material having a first dielectric constant and a first thickness. The base station antenna further includes a dielectric plate 50 that is extending between the array 30 and the radome 40. A shape of dielectric plate 50 matches a shape of a corresponding portion of the radome 40. For example, in the embodiment shown in FIG. 7A, the radome 40 includes a substantially flat portion 41 and a curved portion 42. At the substantially flat portion 41 of the radome 40, the dielectric plate 50 may correspondingly have a substantially flat portion 51 opposite thereto; and at the curved portion 42 of the radome 40, the dielectric plate 50 may correspondingly have a curved portion 52 opposite thereto. In an embodiment, the dielectric plate 50 may also include only the substantially flat portion 51 corresponding to and disposed opposite to the portion 41, without including the portion 52 (may be similar to the dielectric plate 80 in FIG. 9). In the embodiment shown in FIG. 7B, the entire radome 40 has a curved shape. The entire dielectric plate 50 has a curved shape accordingly and extends substantially parallel to the radome 40.

The dielectric plate 50 has a second dielectric constant and a second thickness. There is a gas A (such as vacuum, air or other gases) between the dielectric plate 50 and the radome 40, and the gas A has a third dielectric constant and a third thickness (i.e., a distance between the dielectric plate 50 and the radome 40). Each of the first and second dielectric constants is greater than the third dielectric constant so that the dielectric plate 50, the gas A, and the radome 40 combine to form a structure similar to the dielectric layers 11 to 13 of the radome 10 as described in the above embodiments, which can produce a similar effect. The structure of the base station antenna according to this embodiment makes it possible to readily improve the conventional base station antenna without modifying the manufacturing process of the conventional radome, and thus has low costs. The thicknesses and dielectric constants of each dielectric layers, i.e., the dielectric plate 50, the gas A, and the radome 40, may be determined with reference to the relevant description in the above embodiments. In some embodiments, the distance between the dielectric plate 50 and the radome 40 (i.e., the third thickness) at various portions is substantially identical. In some further embodiments, the third thickness is increased from a location of the dielectric plate 50 close to the center of the array 30 (e.g., a location near the portion 51) to a location of the dielectric plate 50 close to the edge portion of the array 30 (e.g., a location near the portion 52).

Figure 2:
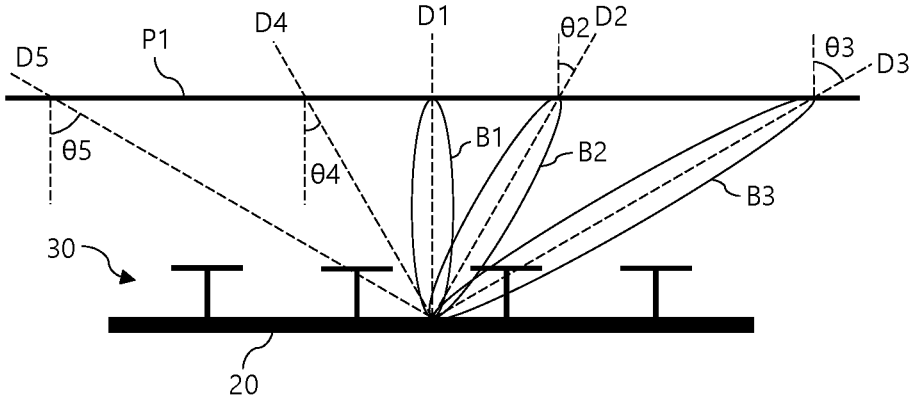
FIG. 2 is a schematic view showing incident angles at which electromagnetic waves are received by the radome in FIG. 1.
Figure 11A:
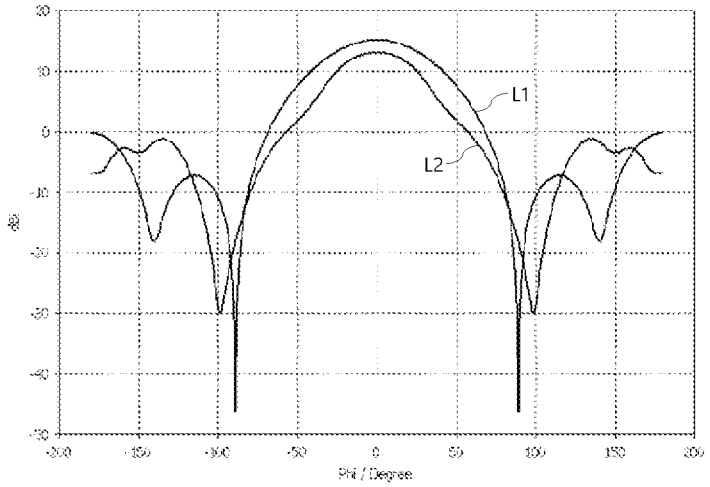
FIGS. 11A and 11B are simulations of radiation patterns on the azimuth plane of a single column of radiating elements, including a radiation pattern without a radome, a radiation pattern with the radome in FIG. 1, and a radiation pattern with the radome and the dielectric plate in FIG. 7A.
Figure 11B:
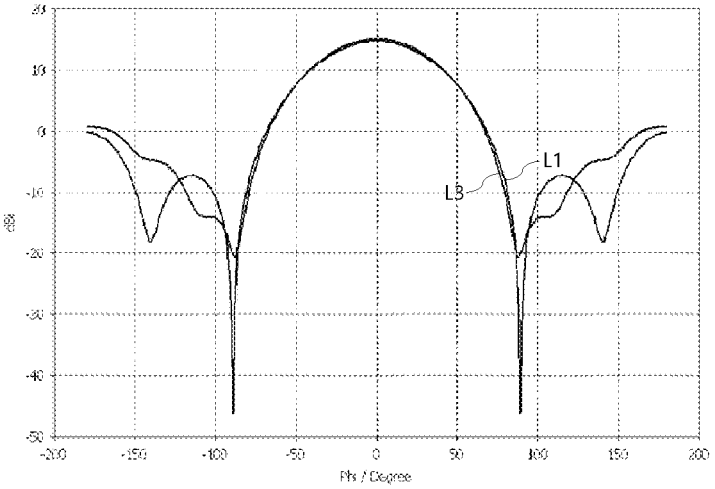
Figure 12A:
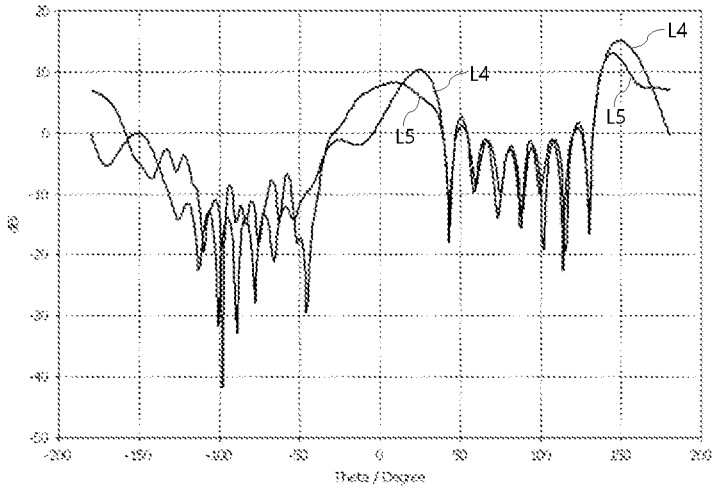
FIGS. 12A and 12B are simulations of radiation patterns on the elevation plane of a single column of radiating elements, including a radiation pattern without a radome, a radiation pattern with the radome in FIG. 1, and a radiation pattern with the radome and the dielectric plate in FIG. 7A.
Figure 12B:
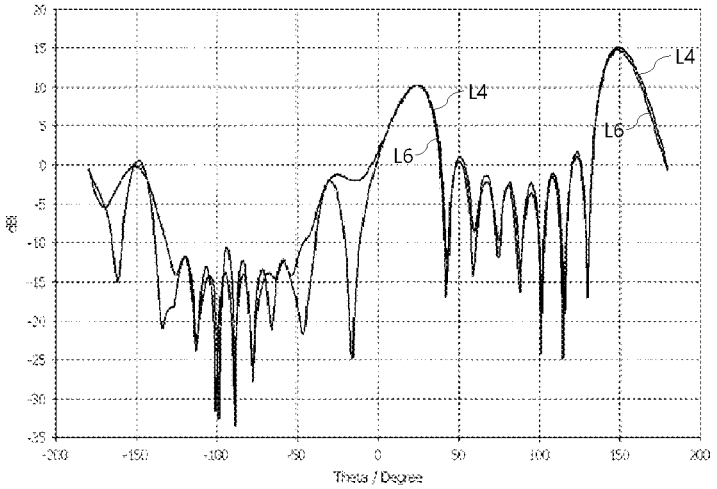

For a single column of radiating elements 31 in the conventional base station antenna shown in FIG. 1 and a single column of radiating elements 31 in the base station antenna according to the embodiment of the present invention shown in FIG. 7A, radiation patterns are simulated at 5 GHz and a 60-degree incident angle with respect to the radome. The simulation results are shown in FIGS. 11A through 12B. In the simulation settings, the material of the radome 1 in FIG. 1 is ASA engineering plastic (dielectric constant is 3.3 and loss tangent is 0.025), and the thickness thereof is uniform everywhere at 2.5 mm. The material of the radome 40 and the dielectric plate 50 in FIG. 7A is ASA engineering plastic (dielectric constant is 3.3 and the loss tangent is 0.025), and the thickness thereof are uniform everywhere at 0.5 mm both. The gas A is vacuum (dielectric constant is 1), and the thickness thereof is uniform everywhere (that is, the distance between the radome 40 and the dielectric plate 50 does not change) at 5 mm. FIGS. 11A and 11B are simulations of radiation patterns on the azimuth plane, where curve L1 corresponds to the case without radome, curve L2 corresponds to the case with radome 1 in FIG. 1, and curve L3 corresponds to the case with the radome 40 and the dielectric plate 50 in FIG. 7A. For the main lobe of the antenna beam where is interest (for example, within the range of azimuth Phi from about −60 degrees to about 60 degrees), the gain of the curve L2 is significantly smaller than that of the curve L1, and the curve L2 distorts compared to the curve L1, while the gain and shape of the curve L3 are both basically agree with the curve L1. FIGS. 12A and 12B are simulations of radiation patterns on the elevation plane, where curve L4 corresponds to the case without radome, curve L5 corresponds to the case with radome 1 in FIG. 1, and curve L6 corresponds to the case with the radome 40 and the dielectric plate 50 in FIG. 7A. For the two main lobes of the antenna beam where is interest (for example, the elevation angle Theta is near 30 or 150 degrees), the gain of the curve L5 is significantly smaller than that of the curve L4, and the curve L5 distorts compared to the curve L4, while the gain and shape of the curve L6 are both basically agree with the curve L4. It can be seen that at 5 GHz and the incident angle with respect to the radome is 60 degrees, the combination of the radome 40 and the dielectric plate 50 in the base station antenna according to the embodiment of the present invention may have better transmittance of electromagnetic waves and may improve radiation patterns compared with the radome 1 in the conventional base station antenna.

Figure 8A:
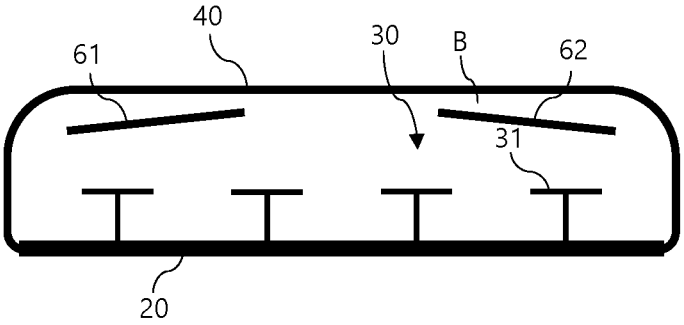
FIGS. 8A and 8B are schematic horizontal cross-sectional views of base station antennas according to further embodiments of the present invention.
Figure 8B:
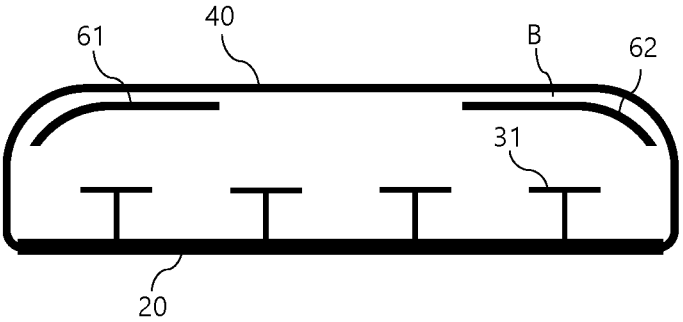

FIGS. 8A and 8B schematically show base station antennas according to further embodiments of the present invention. The base station antenna includes, in addition to the mounting plate 20, the array 30 of radiating elements 31 and the radome 40, which are the same as or similar to those in the above described embodiments, dielectric plates 61 and 62 that are disposed between the array 30 and the radome 40. Dielectric plates 61 and 62 may extend substantially parallel to the radome 40. There is a gas B (such as vacuum, air or other gases) between the dielectric plates 61, 62 and the radome 40. The dielectric plates 61 and 62 are disposed apart from each other in regions corresponding to two opposite edge portions of the radome 40 (for example, the left edge portion and the right edge portion, the upper edge portion and the lower edge portion, the lower left edge portion and the upper right edge portion, etc.). Thus, in the center of the base station antenna, electromagnetic waves are radiated outside through the radome 40 rather than through the dielectric plate 61 or 62, whereas at the edge portions of the antenna, electromagnetic waves are radiated outside through the radome 40 and the dielectric plate 61 or 62. Therefore, at the edge portions of the base station antenna, the dielectric plate 61 or 62, the gas B and the radome 40 combine to constitute a configuration similar to the dielectric layers 11 to 13 as described in the above embodiments, which can improve the performance of the base station antenna in the case of the incident angle of the electromagnetic wave being large. The shape of the dielectric plate 61 or 62 may match the shape of respective corresponding portions of the radome 40. In the embodiment shown in FIG. 8A, for each of the dielectric plates 61, 62, the distance between the dielectric plate 61 or 62 and the radome 40 (i.e., a thickness of the gas B) increases from a portion of the dielectric plate that is close to a center portion of the array 30 to a portion of the dielectric plate that is close to an edge portion of the array 30. In the embodiment shown in FIG. 8B, the distance between the various portions of each of the dielectric plates 61, 62 and the radome 40 is substantially identical.

Figure 9:
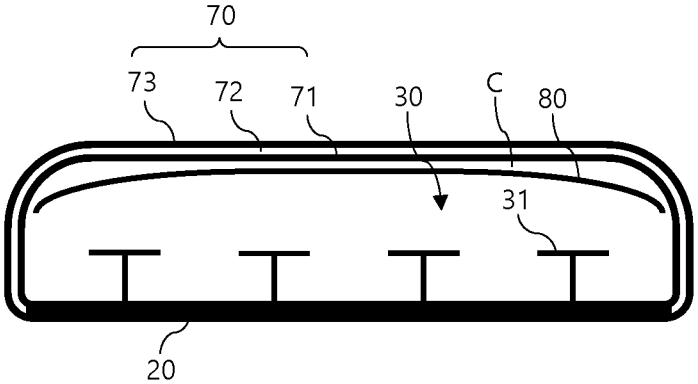
FIG. 9 is a schematic horizontal cross-sectional view of a base station antenna according to an additional embodiment of the present invention.

FIG. 9 schematically shows a base station antenna according to an additional embodiment of the present invention. In addition to the mounting plate 20 and the array 30 of radiating elements 31 that are the same as or similar to those in the above described embodiments and the dielectric plate 80 that is similar to the dielectric plate 50 in the above embodiment, the base station antenna further includes a radome 70 similar to the radome 10 as described in the above embodiment, where the dielectric layers 71 to 73 are similar to the dielectric layers 11 to 13 in the radome 10, respectively. There is a gas C between the dielectric plate 80 and the radome 70, such that the dielectric plate 80, the gas C, and the dielectric layers 71 to 73 of the radome 70 combine to form a configuration similar to the dielectric layers 91 to 95 of the radome 90 as described in the above embodiments, which may produce similar effects.

Although some specific embodiments of the present invention have been described in detail with examples, it should be understood by a person skilled in the art that the above examples are only intended to be illustrative but not to limit the scope of the present invention. The embodiments disclosed herein can be combined arbitrarily with each other, without departing from the scope and spirit of the present invention. It should be understood by a person skilled in the art that the above embodiments can be modified without departing from the scope and spirit of the present invention. The scope of the present invention is defined by the attached claims.

The invention claimed is:

1. A radome for a base station antenna, comprising:

a first dielectric layer having a first dielectric constant and a first thickness;

a second dielectric layer having a second dielectric constant and a second thickness, the second dielectric layer being positioned on an outer side of the first dielectric layer; and a third dielectric layer having a third dielectric constant and a third thickness, the third dielectric layer being positioned on an outer side of the second dielectric layer, wherein each of the first and third dielectric constants is greater than the second dielectric constant.

2. The radome according to claim 1, wherein the second thickness is greater than each of the first and third thicknesses.

3. The radome according to claim 2, wherein the second thickness is 2 to 15 times at least one of the first and third thicknesses.

4. The radome according to claim 1, wherein the second thickness is equal to or less than one quarter of a wavelength of an electromagnetic wave in the second dielectric layer that is emitted by the base station antenna.

5. The radome according to claim 1, wherein the second dielectric layer comprises or is vacuum or gas.

6. The radome according to claim 1, wherein a material of the second dielectric layer is a honeycombed, a foamed, a porous, and/or a meshed solid.

7. The radome according to claim 1, wherein the third dielectric layer is a protective layer applied to the outer side of the second dielectric layer.

8. The radome according to claim 1, wherein the first dielectric constant is equal to the third dielectric constant, and/or the first thickness is equal to the third thickness.

9. The radome according to claim 1, wherein the second thickness is increased from a center portion of the radome to an edge portion of the radome.

10. The radome according to claim 1, wherein the first through third dielectric layers are monolithic.

11. The radome according to claim 1, further comprising:

a fourth dielectric layer having a fourth dielectric constant and a fourth thickness, the fourth dielectric layer being positioned on an outer side of the third dielectric layer; and a fifth dielectric layer having a fifth dielectric constant and a fifth thickness, the fifth dielectric layer being positioned on an outer side of the fourth dielectric layer, wherein each of the third and fifth dielectric constants is greater than the fourth dielectric constant, and the fourth thickness is greater than each of the third and fifth thicknesses.

12. A base station antenna, comprising:

an array of radiating elements; and a radome according to claim 1, wherein the first dielectric layer is closer to the array of radiating elements than the third dielectric layer.

13. A base station antenna, comprising:

an array of radiating elements configured to emit an electromagnetic wave;

a radome including a first dielectric layer, the first dielectric layer having a first dielectric constant and a first thickness; and a dielectric plate that is extending between the array of radiating elements and the radome, the dielectric plate having a second dielectric constant and a second thickness, wherein there is a first gas between the dielectric plate and the radome, and each of the first and second dielectric constants is greater than a dielectric constant of the first gas, and a shape of the dielectric plate matches a shape of a corresponding portion of the radome.

14. The base station antenna according to claim 13, wherein a first distance between the dielectric plate and the radome is greater than each of the first and second thicknesses.

15. The base station antenna according to claim 14, wherein the first distance is 2 to 15 times at least one of the first and second thicknesses.

16. The base station antenna according to claim 14, wherein the first distance is equal to or less than one quarter of a wavelength of the electromagnetic wave in the first gas.

17. The base station antenna according to claim 13, wherein a first distance between the dielectric plate and the radome increases from a first portion of the dielectric plate that is close to a center portion of the array of radiating elements to a second portion of the dielectric plate that is close to an edge portion of the array of radiating elements.

18. The base station antenna according to claim 13, wherein the first dielectric constant is equal to the second dielectric constant, and/or the first thickness is equal to the second thickness.

19. The base station antenna according to claim 13, wherein the dielectric plate includes a first dielectric plate and a second dielectric plate that are spaced apart from each other and that are disposed in regions corresponding to two opposite edge portions of the radome, respectively.

20. The base station antenna according to claim 19, wherein the two opposite edge portions include a left edge portion and a right edge portion, or an upper edge portion and a lower edge portion.

21. The base station antenna according to claim 13, the radome further comprising:

a second dielectric layer having a third dielectric constant and a third thickness, the second dielectric layer being positioned on an outer side of the first dielectric layer; and a third dielectric layer having a fourth dielectric constant and a fourth thickness, the third dielectric layer being positioned on an outer side of the second dielectric layer, wherein each of the first and fourth dielectric constants is greater than the third dielectric constant, and the third thickness is greater than each of the first and fourth thicknesses.

* * * * *